US009073663B2

(12) United States Patent
Holley, Jr. et al.

(10) Patent No.: US 9,073,663 B2
(45) Date of Patent: Jul. 7, 2015

(54) CARTON WITH INSERT

(71) Applicant: Graphic Packing International, Inc., Atlanta, GA (US)

(72) Inventors: John Murdick Holley, Jr., Lawrenceville, GA (US); Michael R. Schmal, Atlanta, GA (US); Mark Baldino, Marietta, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 146 days.

(21) Appl. No.: 13/827,425

(22) Filed: Mar. 14, 2013

(65) Prior Publication Data

US 2014/0021247 A1 Jan. 23, 2014

Related U.S. Application Data

(60) Provisional application No. 61/741,314, filed on Jul. 17, 2014, provisional application No. 61/741,315, filed on Jul. 17, 2012, provisional application No. 61/797,758, filed on Dec. 14, 2012.

(51) Int. Cl.
*B65D 71/00* (2006.01)
*B65D 5/468* (2006.01)
(Continued)

(52) U.S. Cl.
CPC ..... *B65D 5/4608* (2013.01); *B65D 5/445* (2013.01); *B65D 5/18* (2013.01); *B31B 49/02* (2013.01);
(Continued)

(58) Field of Classification Search
CPC ..... B65D 2571/00493; B65D 2571/0066; B65D 2571/00456; B65D 2571/005
USPC ..... 206/427, 148, 156, 141, 433, 434, 435, 206/162, 199, 200; 229/117.13, 199, 229/117.26, 117.16, 103.2, 117.17, 930
See application file for complete search history.

(56) References Cited

U.S. PATENT DOCUMENTS 1,925,102 A 9/1933 Levkoff
2,005,924 A 6/1935 Wilson
(Continued)

FOREIGN PATENT DOCUMENTS

CA 873185 6/1971
DE G 93 12 950.5 10/1993
(Continued)

OTHER PUBLICATIONS

International Search Report and Written Opinion, mailed Jun. 24, 2013, for related Application No. PCT/US2013/031457.

*Primary Examiner* — Mickey Yu
*Assistant Examiner* — Gideon Weinerth
(74) *Attorney, Agent, or Firm* — Womble Carlyle Sandridge & Rice, LLP

(57) ABSTRACT

A carton for holding a plurality of containers. The carton has a top panel, a bottom panel, a first side panel, and a second side panel. A plurality of end flaps is respectively foldably connected to respective panels of the plurality of panels. The plurality of end flaps is at least partially overlapped with respect to one another to thereby at least partially form a closed end of the carton. The carton has a handle formed in at least one of the plurality of end flaps. A reinforcing insert can comprise a central panel, a first end flap, and second end flap foldably connected to the central panel. The central panel at least partially overlaps the top panel, the first end flap is positioned for contact with at least one of the plurality of containers, and the second end flap is positioned for reinforcing the handle.

26 Claims, 9 Drawing Sheets

(51) Int. Cl.

| | |
|---|---|
| ***B65D 5/44*** | (2006.01) |
| ***B65D 5/18*** | (2006.01) |
| ***B31B 49/02*** | (2006.01) |
| ***B65D 5/42*** | (2006.01) |
| ***B65D 71/18*** | (2006.01) |

(52) U.S. Cl.

CPC ..... *B65D 5/42* (2013.01); *B65D 71/18* (2013.01); *B65D 2571/00141* (2013.01); *B65D 2571/00308* (2013.01); *B65D 2571/0045* (2013.01); *B65D 2571/00561* (2013.01); *B65D 2571/0066* (2013.01); *B65D 2571/00728* (2013.01)

(56) References Cited

U.S. PATENT DOCUMENTS

| | | | | | |
|---|---|---|---|---|---|
| 2,067,749 | A | | 1/1937 | Zimmerman et al. | |
| 2,115,673 | A | | 4/1938 | Stompe | |
| 2,196,502 | A | | 4/1940 | Kells | |
| 2,216,299 | A | * | 10/1940 | Schilling | 229/117.17 |
| 2,297,284 | A | * | 9/1942 | Blackman | 206/139 |
| 2,299,027 | A | | 10/1942 | Novak | |
| 2,386,905 | A | | 10/1945 | Meitzen | |
| 2,648,484 | A | | 8/1953 | Belsinger | |
| 2,669,351 | A | | 2/1954 | Carson et al. | |
| 2,754,047 | A | | 7/1956 | Schmidt et al. | |
| 3,078,032 | A | | 2/1963 | Robinson et al. | |
| 3,128,010 | A | | 4/1964 | Forrer | |
| 3,133,634 | A | | 5/1964 | Bozdar | |
| 3,173,596 | A | | 3/1965 | Aust et al. | |
| 3,178,242 | A | | 4/1965 | Ellis et al. | |
| 3,228,582 | A | | 1/1966 | Osberg | |
| 3,263,861 | A | | 8/1966 | Carr | |
| 3,265,283 | A | | 8/1966 | Farquhar | |
| 3,300,115 | A | | 1/1967 | Schauer | |
| 3,332,594 | A | | 7/1967 | De Capua | |
| 3,346,167 | A | | 10/1967 | Schmidt | |
| 3,356,279 | A | | 12/1967 | Root | |
| 3,517,858 | A | | 6/1970 | Farquhar | |
| 3,533,549 | A | | 10/1970 | Gilchrist | |
| 3,540,581 | A | | 11/1970 | Koolnis | |
| 3,744,709 | A | * | 7/1973 | Akkerman | 206/161 |
| 3,788,538 | A | * | 1/1974 | Kuenzi | 229/117.17 |
| 3,825,170 | A | * | 7/1974 | Aust et al. | 229/104 |
| 3,904,036 | A | | 9/1975 | Forrer | |
| 4,155,449 | A | | 5/1979 | Bryne | |
| 4,214,660 | A | | 7/1980 | Hunt, Jr. | |
| 4,222,485 | A | | 9/1980 | Focke | |
| 4,256,226 | A | | 3/1981 | Stone | |
| 4,318,474 | A | | 3/1982 | Hasegawa | |
| 4,364,509 | A | | 12/1982 | Holley, Jr. et al. | |
| 4,375,258 | A | | 3/1983 | Crayne et al. | |
| 4,376,509 | A | | 3/1983 | Schaffer | |
| 4,378,877 | A | | 4/1983 | Botterman et al. | |
| 4,396,143 | A | | 8/1983 | Killy | |
| 4,417,655 | A | | 11/1983 | Forbes, Jr. | |
| 4,417,661 | A | | 11/1983 | Roccaforte | |
| 4,538,759 | A | | 9/1985 | Dutcher | |
| 4,577,762 | A | | 3/1986 | Kuchenbecker | |
| 4,588,084 | A | | 5/1986 | Holley, Jr. | |
| 4,605,128 | A | | 8/1986 | Rieke | |
| 4,621,766 | A | | 11/1986 | McClure | |
| 4,658,984 | A | | 4/1987 | Brunner | |
| 4,718,597 | A | * | 1/1988 | Bishop | 229/117.16 |
| 4,757,938 | A | | 7/1988 | Collins | |
| 4,817,866 | A | | 4/1989 | Wonnacott | |
| 4,830,267 | A | * | 5/1989 | Wilson | 206/141 |
| 4,890,440 | A | | 1/1990 | Romagnoli | |
| 4,949,845 | A | | 8/1990 | Dixon | |
| 4,967,901 | A | | 11/1990 | Wood | |
| 4,974,771 | A | | 12/1990 | Lavery | |
| 5,072,876 | A | * | 12/1991 | Wilson | 229/103.2 |
| 5,101,642 | A | | 4/1992 | Alexandrov | |
| 5,119,985 | A | | 6/1992 | Dawson et al. | |
| 5,137,211 | A | | 8/1992 | Summer et al. | |
| 5,219,229 | A | | 6/1993 | Sengewald | |
| 5,221,041 | A | * | 6/1993 | Stout et al. | 229/117.13 |
| 5,224,919 | A | | 7/1993 | Walsh | |
| 5,249,681 | A | | 10/1993 | Miller | |
| 5,297,725 | A | | 3/1994 | Sutherland | |
| 5,320,277 | A | | 6/1994 | Stout et al. | |
| 5,333,734 | A | | 8/1994 | Stout et al. | |
| 5,350,109 | A | | 9/1994 | Brown et al. | |
| 5,425,474 | A | | 6/1995 | Dalea et al. | |
| 5,482,185 | A | | 1/1996 | McNaughton | |
| 5,482,203 | A | | 1/1996 | Stout | |
| 5,505,372 | A | | 4/1996 | Edson et al. | |
| 5,575,421 | A | * | 11/1996 | Heo | 229/117.16 |
| 5,577,612 | A | | 11/1996 | Chesson et al. | |
| 5,588,585 | A | | 12/1996 | McClure | |
| 5,597,114 | A | | 1/1997 | Kramedjian et al. | |
| 5,622,309 | A | | 4/1997 | Matsuda et al. | |
| 5,647,483 | A | * | 7/1997 | Harris | 206/427 |
| 5,664,683 | A | | 9/1997 | Brody | |
| 5,690,213 | A | | 11/1997 | Matsumura | |
| 5,690,230 | A | | 11/1997 | Griffith | |
| 5,794,778 | A | | 8/1998 | Harris | |
| 5,826,783 | A | | 10/1998 | Stout | |
| 5,873,516 | A | | 2/1999 | Boggs | |
| 5,875,961 | A | | 3/1999 | Stone et al. | |
| 5,881,884 | A | | 3/1999 | Podosek | |
| 5,921,398 | A | | 7/1999 | Carroll | |
| 5,924,559 | A | | 7/1999 | Carrel et al. | |
| 5,927,498 | A | | 7/1999 | Saam | |
| 6,050,402 | A | | 4/2000 | Walter | |
| 6,170,741 | B1 | | 1/2001 | Skolik et al. | |
| 6,176,419 | B1 | | 1/2001 | Holley, Jr. | |
| 6,250,542 | B1 | | 6/2001 | Negelen | |
| 6,283,293 | B1 | | 9/2001 | Lingamfelter | |
| 6,302,320 | B1 | | 10/2001 | Stout | |
| 6,409,077 | B1 | | 6/2002 | Telesca et al. | |
| D459,927 | S | | 7/2002 | Flowers et al. | |
| 6,471,120 | B1 | | 10/2002 | Vogel | |
| 6,478,219 | B1 | | 11/2002 | Holley, Jr. | |
| 6,484,903 | B2 | | 11/2002 | Spivey et al. | |
| 6,550,615 | B2 | | 4/2003 | Lingamfelter | |
| 6,557,699 | B1 | | 5/2003 | Focke et al. | |
| 6,578,736 | B2 | | 6/2003 | Spivey | |
| 6,604,677 | B1 | | 8/2003 | Sutherland et al. | |
| 6,631,803 | B2 | | 10/2003 | Rhodes et al. | |
| 6,669,083 | B2 | | 12/2003 | Bates | |
| 6,715,639 | B2 | | 4/2004 | Spivey | |
| 6,752,262 | B1 | | 6/2004 | Boriani et al. | |
| 6,789,673 | B2 | | 9/2004 | Lingamfelter | |
| 6,848,573 | B2 | | 2/2005 | Gould et al. | |
| 6,866,186 | B2 | | 3/2005 | Fogle et al. | |
| 6,902,104 | B2 | | 6/2005 | Holley, Jr. et al. | |
| 6,918,487 | B2 | | 7/2005 | Harrelson | |
| 6,926,193 | B2 | | 8/2005 | Smalley | |
| 6,929,172 | B2 | | 8/2005 | Bates et al. | |
| 6,932,265 | B2 | | 8/2005 | Sax et al. | |
| 6,968,992 | B2 | | 11/2005 | Schuster | |
| 6,969,172 | B2 | | 11/2005 | Actis-Datta | |
| 6,974,072 | B2 | | 12/2005 | Harrelson | |
| 6,991,107 | B2 | | 1/2006 | Harrelson | |
| 6,997,316 | B2 | | 2/2006 | Sutherland | |
| 7,000,803 | B2 | | 2/2006 | Miller | |
| 7,073,665 | B2 | | 7/2006 | Auclair et al. | |
| 7,104,435 | B2 | | 9/2006 | Holley, Jr. | |
| 7,134,593 | B2 | | 11/2006 | Harrelson | |
| 7,159,759 | B2 | | 1/2007 | Sutherland et al. | |
| 7,225,930 | B2 | | 6/2007 | Ford et al. | |
| 7,422,104 | B2 | | 9/2008 | Perkinson | |
| 7,478,743 | B2 | | 1/2009 | Holley, Jr. | |
| 7,604,157 | B2 | | 10/2009 | Zammit et al. | |
| 7,699,215 | B2 | | 4/2010 | Spivey, Sr. | |
| 7,708,186 | B2 | * | 5/2010 | Pawlick | 229/117.3 |
| 8,216,118 | B2 | * | 7/2012 | Dunn | 493/128 |
| 8,356,743 | B2 | | 1/2013 | Spivey, Sr. | |
| 8,356,744 | B2 | | 1/2013 | Brand et al. | |
| 8,376,214 | B2 | | 2/2013 | Spivey, Sr. et al. | |
| 8,387,855 | B2 | | 3/2013 | Brand | |
| 8,439,194 | B2 | | 5/2013 | Spivey | |

(56) References Cited

U.S. PATENT DOCUMENTS

| | | | | |
|---|---|---|---|---|
| 8,453,919 | B2 * | 6/2013 | Eckermann et al. | 229/117.13 |
| 2002/0029991 | A1 | 3/2002 | Lingamfelter | |
| 2002/0070139 | A1 | 6/2002 | Bates | |
| 2002/0088820 | A1 | 7/2002 | Spivey | |
| 2002/0088821 | A1 | 7/2002 | Spivey et al. | |
| 2002/0185499 | A1 | 12/2002 | Harrelson et al. | |
| 2003/0006158 | A1 | 1/2003 | Skolik et al. | |
| 2003/0136820 | A1 | 7/2003 | Negelen | |
| 2003/0141313 | A1 | 7/2003 | Bates | |
| 2003/0150759 | A1 | 8/2003 | White, Jr. | |
| 2003/0192907 | A1 | 10/2003 | Bates | |
| 2004/0040334 | A1 | 3/2004 | Rusnock | |
| 2004/0060972 | A1 | 4/2004 | Harrelson | |
| 2004/0089575 | A1 | 5/2004 | Lingamfelter | |
| 2004/0089671 | A1 | 5/2004 | Miller | |
| 2004/0099558 | A1 | 5/2004 | Oliff et al. | |
| 2004/0155098 | A1 | 8/2004 | Harrelson | |
| 2004/0188277 | A1 | 9/2004 | Auclair | |
| 2004/0188300 | A1 | 9/2004 | Sutherland | |
| 2004/0188508 | A1 | 9/2004 | Holley, Jr. et al. | |
| 2005/0023170 | A1 | 2/2005 | Lingamfelter | |
| 2005/0092820 | A1 | 5/2005 | Chekroune | |
| 2005/0115843 | A1 | 6/2005 | Harrelson | |
| 2005/0126947 | A1 | 6/2005 | Holley, Jr. | |
| 2005/0167291 | A1 | 8/2005 | Sutherland | |
| 2005/0167478 | A1 | 8/2005 | Holley, Jr. | |
| 2005/0189405 | A1 | 9/2005 | Gomes et al. | |
| 2005/0263574 | A1 * | 12/2005 | Schuster | 229/117.16 |
| 2006/0054522 | A1 | 3/2006 | Kline et al. | |
| 2006/0081691 | A1 | 4/2006 | Smalley | |
| 2006/0091193 | A1 | 5/2006 | DeBusk et al. | |
| 2006/0118606 | A1 | 6/2006 | Holley, Jr. et al. | |
| 2006/0131370 | A1 | 6/2006 | Bates | |
| 2006/0175386 | A1 | 8/2006 | Holley, Jr. | |
| 2006/0231441 | A1 | 10/2006 | Gomes | |
| 2006/0231600 | A1 | 10/2006 | Holley, Jr. | |
| 2006/0249413 | A1 | 11/2006 | Auclair et al. | |
| 2006/0278689 | A1 | 12/2006 | Boshinski et al. | |
| 2007/0007325 | A1 | 1/2007 | Suzuki et al. | |
| 2007/0029371 | A1 | 2/2007 | Theelen | |
| 2007/0108261 | A1 | 5/2007 | Schuster | |
| 2007/0131748 | A1 | 6/2007 | Brand | |
| 2007/0164093 | A1 | 7/2007 | Spivey et al. | |
| 2007/0181658 | A1 | 8/2007 | Sutherland | |
| 2007/0205255 | A1 | 9/2007 | Dunn | |
| 2007/0210144 | A1 | 9/2007 | Brand | |
| 2007/0251982 | A1 | 11/2007 | Brand | |
| 2007/0295790 | A1 | 12/2007 | Zammit et al. | |
| 2008/0023535 | A1 | 1/2008 | Holley, Jr. | |
| 2008/0048014 | A1 | 2/2008 | Bates | |
| 2008/0128479 | A1 | 6/2008 | Bates et al. | |
| 2008/0257943 | A1 * | 10/2008 | Blin | 229/117.16 |
| 2009/0282843 | A1 | 11/2009 | Brand | |
| 2010/0044420 | A1 | 2/2010 | Brand et al. | |
| 2010/0122999 | A1 | 5/2010 | Brand | |
| 2010/0237138 | A1 | 9/2010 | Bradford | |
| 2011/0011924 | A1 | 1/2011 | Spivey et al. | |
| 2011/0049228 | A1 | 3/2011 | Brand | |
| 2011/0068160 | A1 | 3/2011 | Brand et al. | |
| 2011/0290692 | A1 | 12/2011 | Spivey, Sr. | |
| 2012/0067755 | A1 | 3/2012 | Spivey, Sr. | |
| 2012/0091021 | A1 | 4/2012 | Smalley | |
| 2013/0118942 | A1 | 5/2013 | Smalley et al. | |
| 2013/0119122 | A1 | 5/2013 | Spivey, Sr. | |
| 2013/0292285 | A1 * | 11/2013 | Kastanek | 206/433 |

FOREIGN PATENT DOCUMENTS

| | | |
|---|---|---|
| DE | 298 15 677 | 11/1998 |
| EP | 0 066 029 | 12/1982 |
| EP | 1 433 714 | 6/2004 |
| EP | 1 698 565 | 9/2006 |
| FR | 2 549 010 | 1/1985 |
| GB | 2 264 101 | 8/1993 |
| JP | 2002-128064 | 5/2002 |
| JP | 2006-111342 | 4/2006 |
| JP | 2007-55630 | 3/2007 |
| JP | 2007-532421 | 11/2007 |
| JP | 2010-149927 | 7/2010 |
| KR | 10-0154124 | 2/1999 |
| KR | 10-0371048 | 8/2003 |
| WO | WO 96/21603 | 7/1996 |
| WO | WO 96/29260 | 9/1996 |
| WO | WO 99/28198 | 6/1999 |
| WO | WO 99/64301 | 12/1999 |
| WO | WO 00/03937 | 1/2000 |
| WO | WO 02/47990 | 6/2002 |
| WO | WO 2004/043790 | 5/2004 |
| WO | WO 2005/051781 | 6/2005 |
| WO | WO 2005/100175 | 10/2005 |
| WO | WO 2006/050210 | 5/2006 |
| WO | WO 2006/050316 | 5/2006 |
| WO | WO2007/005908 | 1/2007 |
| WO | WO 2007/076544 | 7/2007 |
| WO | WO 2012/003251 | 1/2012 |

* cited by examiner

CARTON WITH INSERT

CROSS-REFERENCE TO RELATED APPLICATIONS

This application claims the benefit of U.S. Provisional Patent Application No. 61/741,314, filed Jul. 17, 2012, U.S. Provisional Patent Application No. 61/741,315, filed Jul. 17, 2012, and U.S. Provisional Patent Application No. 61/797,758, filed Dec. 14, 2012.

INCORPORATION BY REFERENCE

The disclosures of U.S. Provisional Patent Application No. 61/741,314, which was filed on Jul. 17, 2012, U.S. Provisional Patent Application No. 61/741,315, which was filed on Jul. 17, 2012, U.S. Provisional Patent Application No. 61/797,758, which was filed on Dec. 14, 2012, and U.S. patent application Ser. No. 13/419,740, which was filed on Mar. 14, 2012, are hereby incorporated by reference for all purposes as if presented herein in their entirety, for all purposes.

BACKGROUND OF THE DISCLOSURE

The present disclosure generally relates to cartons for holding beverage containers or other types of articles. More specifically, the present disclosure relates to cartons having a reinforcing insert.

SUMMARY OF THE DISCLOSURE

In general, one aspect of the disclosure is directed to a carton for holding a plurality of containers. The carton can comprise a plurality of panels that extends at least partially around an interior of the carton. The plurality of panels comprises a top panel, a bottom panel, a first side panel, and a second side panel. A plurality of end flaps are respectively foldably connected to respective panels of the plurality of panels. The end flaps of the plurality of end flaps are at least partially overlapped with respect to one another to thereby at least partially form a closed end of the carton. A handle can be formed in the closed end of the carton. A reinforcing insert can comprise a central panel, a first insert end flap, and second insert end flap foldably connected to the central panel. The top panel at least partially overlaps the central panel, the first insert end flap is positioned for contact with at least one of the plurality of containers, and the second insert end flap is positioned for reinforcing the handle.

In another aspect, the disclosure is generally directed to, in combination, a carton blank and a reinforcing insert for forming a carton for holding a plurality of containers. The carton blank can comprise a plurality of panels comprising a top panel, a bottom panel, a first side panel, and a second side panel. A plurality of end flaps are respectively foldably connected to respective panels of the plurality of panels. The plurality of end flaps are for being at least partially overlapped with respect to one another to thereby at least partially form a closed end of the carton formed from the blank. The carton blank can also comprise handle features for forming a handle in the closed end of the carton formed from the blank. The reinforcing insert can comprise a central panel, a first insert end flap, and second insert end flap foldably connected to the central panel. The top panel at least partially overlaps the central panel, the first insert end flap is positioned for contact with at least one of the plurality of containers when the carton is formed from the blank, and the second insert end flap is positioned for reinforcing the handle when the carton is formed from the blank.

In another aspect, the disclosure is generally directed to a method of forming a carton for holding a plurality of containers. The method comprises obtaining a carton blank and a reinforcing insert. The carton blank comprises a plurality of panels comprising a top panel, a bottom panel, a first side panel, and a second side panel. A plurality of end flaps are respectively foldably connected to respective panels of the plurality of panels. The carton blank can also comprise handle features. The reinforcing insert comprises a central panel, a first insert end flap, and second insert end flap foldably connected to the central panel. The method further can comprise positioning the reinforcing insert relative to the carton blank so that the top panel at least partially overlaps the central panel, and forming an interior of the carton at least partially defined by the plurality of panels. The forming the interior of the carton comprises forming an open-ended sleeve. The method also can comprise at least partially closing an end of the carton by at least partially overlapping the plurality of end flaps with respect to one another. The at least partially closing the end of the carton comprises forming a handle in the end of the carton from the handle features and positioning the second insert end flap to reinforce the handle. The method further can comprise positioning the first insert end flap for contact with at least one of the plurality of containers.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., glass beverage bottles) as disposed within the carton embodiments. In this specification, the terms "inner," "outer," "lower," "bottom," "upper," and "top" indicate orientations determined in relation to fully erected and upright cartons.

Figure 1:
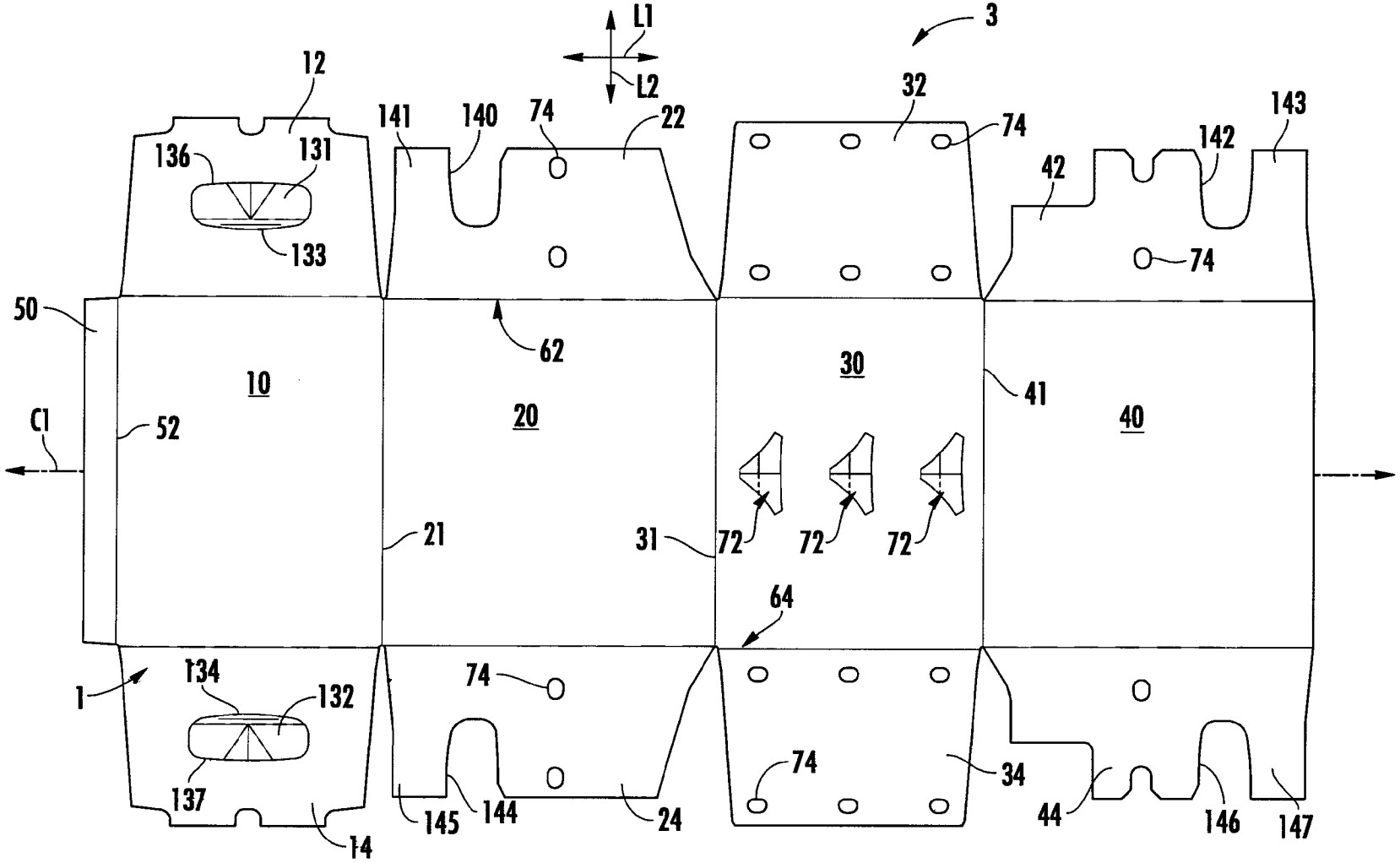
FIG. 1 is a plan view of a carton blank used to form a carton according to an exemplary embodiment of the disclosure.
Figure 4:
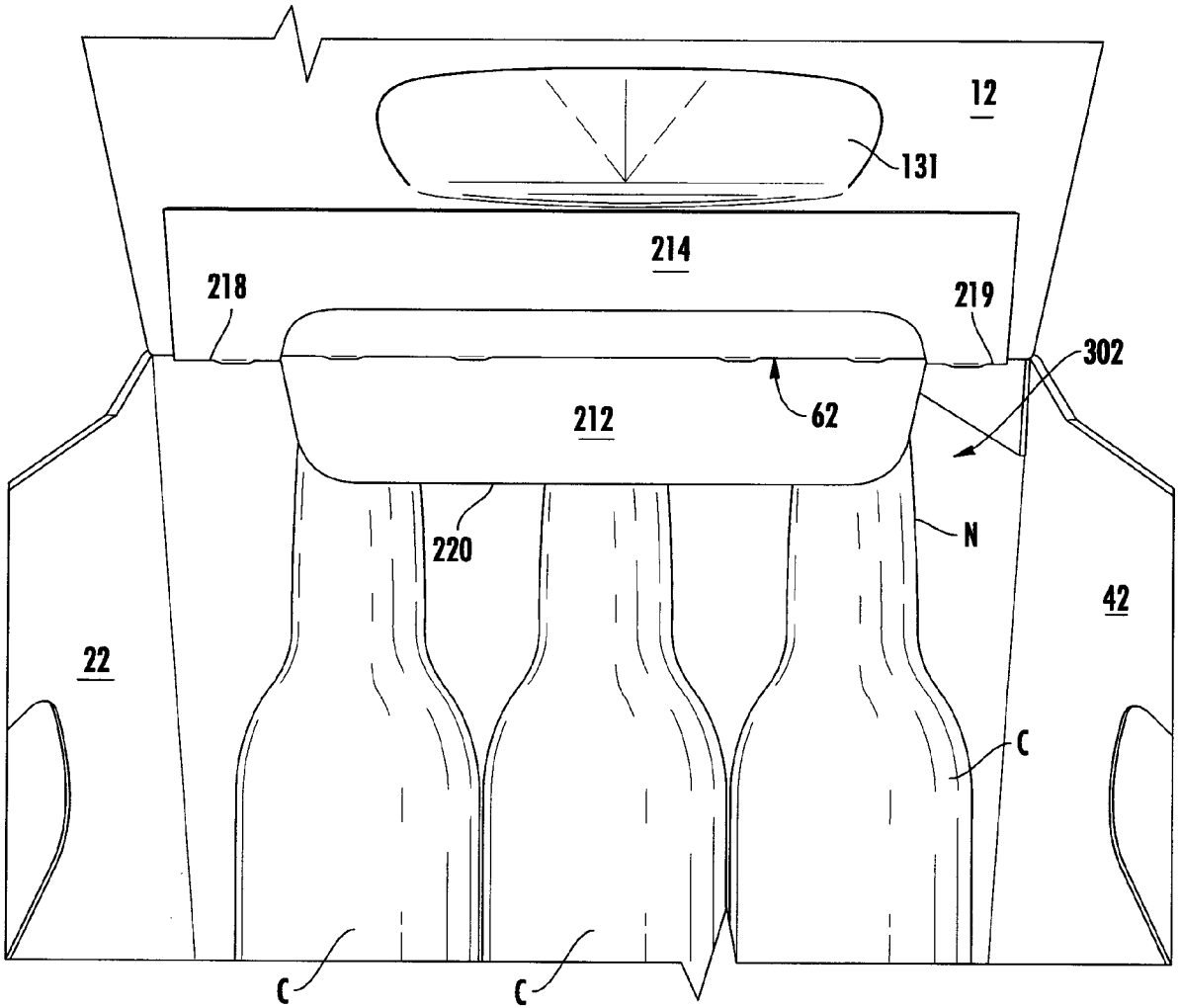
FIG. 4 is a perspective view of an end of the open-ended sleeve with containers according to the exemplary embodiment of the disclosure.
Figure 8:
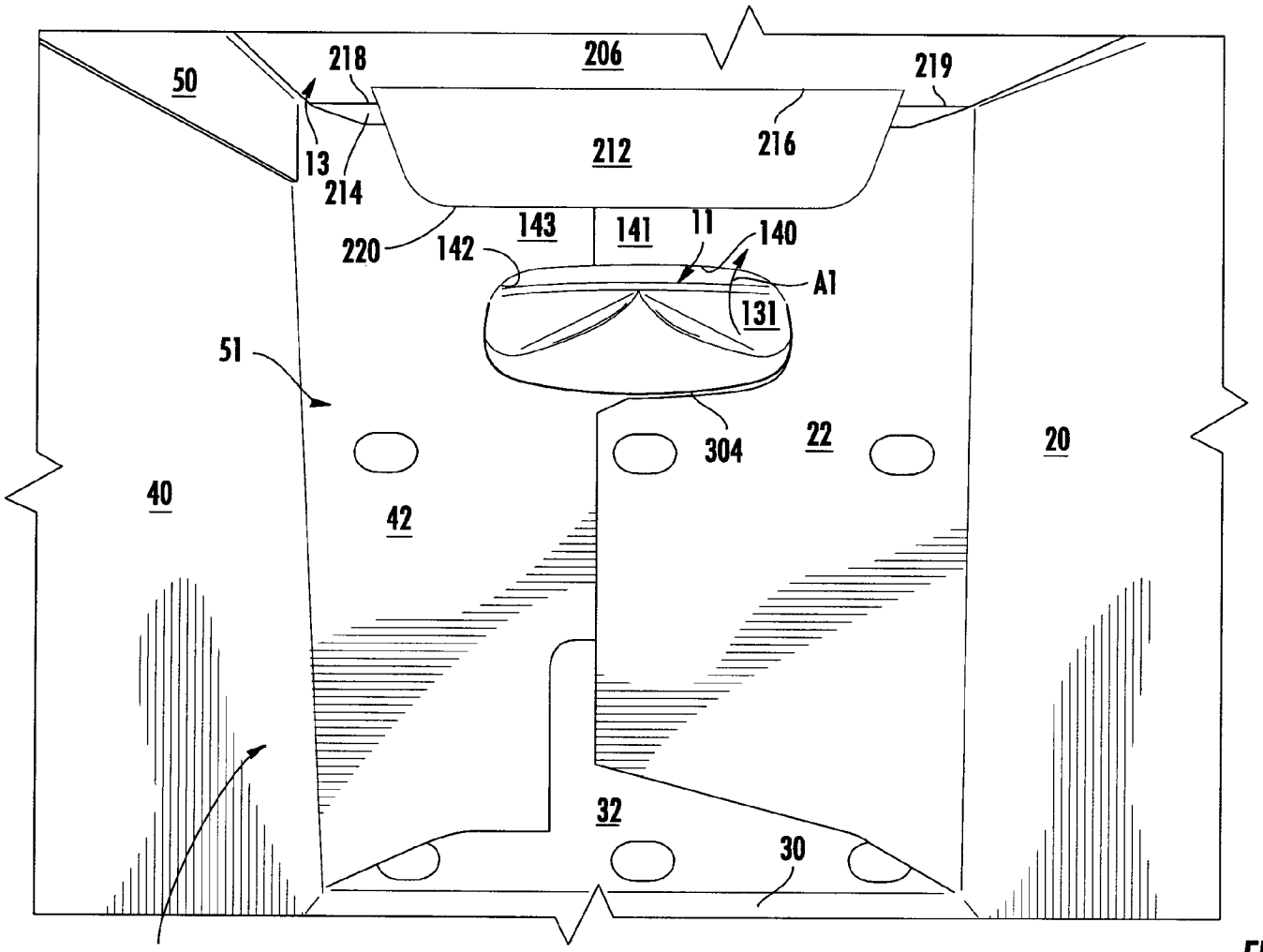
FIG. 8 is perspective view of the end of the carton of FIGS. 6 and 7 from an interior of the carton according to the exemplary embodiment of the disclosure.
Figure 9:
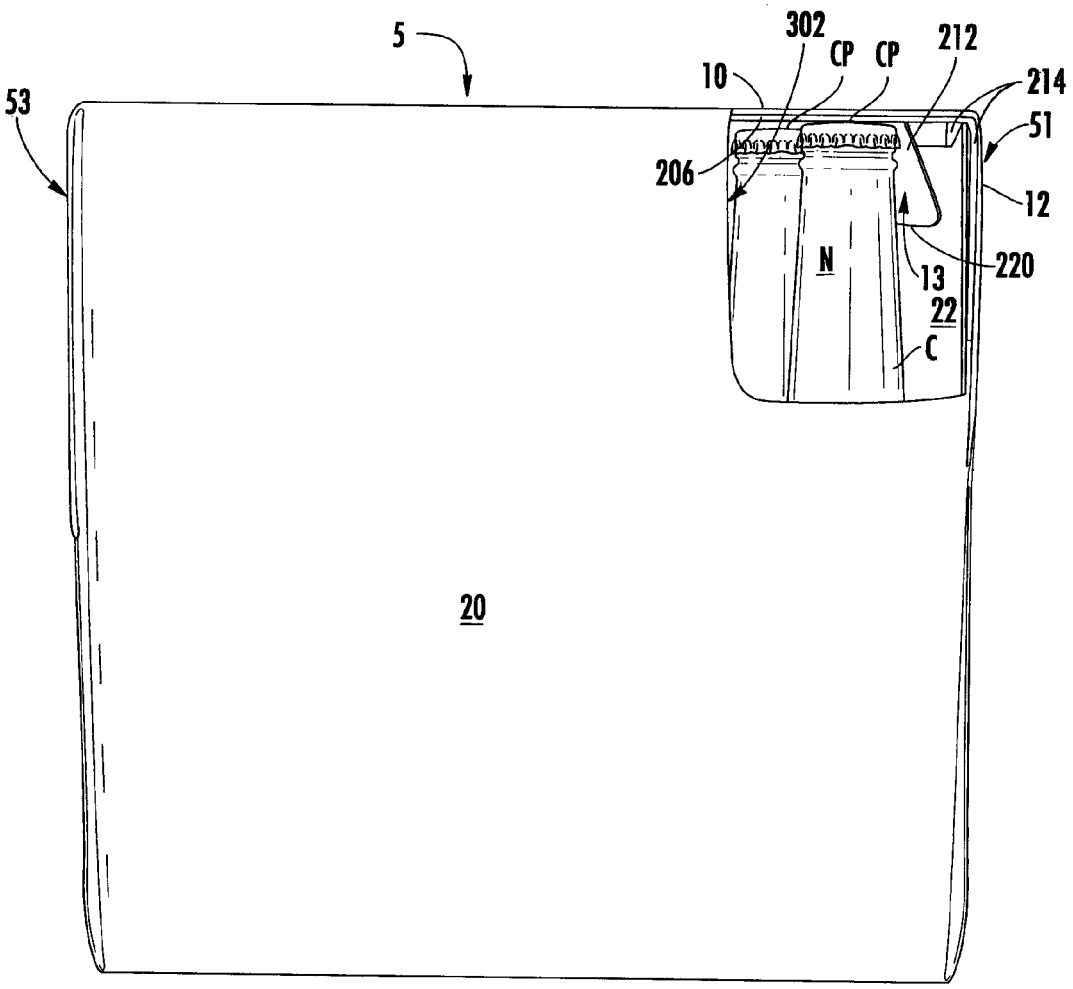
FIG. 9 is a side view of the carton of FIGS. 6 and 7 with a portion of a side panel broken away to show a portion of the interior of the carton according to the exemplary embodiment of the disclosure.

FIG. 1 is a plan view of the exterior side 1 of a blank, generally indicated at 3, used to form a carton 5 (FIG. 6) according to the exemplary embodiment of the disclosure. The carton 5 can be used to house a plurality of articles such as containers C with necks or upper portions N that are generally narrower than the lower portions of the containers (FIG. 4). The containers C can include tops or caps CP (FIG. 9). In the illustrated embodiment, the carton 5 is sized to house twelve containers C in a single layer in a 3×4 arrangement, but it is understood that the carton 5 may be sized and shaped to hold containers of a different or same quantity in more than one layer and/or in different row/column arrangements (e.g., 1×6, 3×6, 2×6×2, 3×5, 4×5, 2×9, 2×6, 3×4, etc.). In the illustrated embodiment, the carton 5 includes first and second handles 11 (FIGS. 6-8) for grasping and carrying the carton at a respective first end 51 and second end 53 of the carton. As will be discussed below in more detail, the handles 11, are formed from various features in the blank 3. The carton 5 includes a reinforcing insert 13 that reinforces and strengthens the handles 11 and reinforces and stabilizes the containers C in the carton.

The carton blank 3 has a longitudinal axis L1 and a lateral axis L2. The carton blank 3 can include a longitudinal centerline C1, as shown in FIG. 1. In the illustrated embodiment, the blank 3 comprises a top panel 10 foldably connected to a first side panel 20 at a first lateral fold line 21. A bottom panel 30 is foldably connected to the first side panel 20 at a second lateral fold line 31. A second side panel 40 is foldably connected to the bottom panel 30 at a third lateral fold line 41. In the illustrated embodiment, the blank 3 includes an attachment flap 50 foldably connected to the top panel 10 at a fourth lateral fold line 52. Any of the top and bottom panels 10, 30 and the first and second side panels 20, 40 can be otherwise shaped, arranged, configured, or omitted, without departing from the disclosure. For example, the blank 3 can alternatively include two top panels cooperating to form a top of the carton 5 or two bottom panels cooperating to form a bottom of the carton. Additionally, the attachment flap 50 could be foldably connected to the second side panel 40 in an alternative embodiment.

The top panel 10 is foldably connected to a first top end flap 12 and a second top end flap 14. The first side panel 20 is foldably connected to a first side end flap 22 and a second side end flap 24. The bottom panel 30 is foldably connected to a first bottom end flap 32 and a second bottom end flap 34. The second side panel 40 is foldably connected to a first side end flap 42 and a second side end flap 44. When the carton 5 is erected, the top and bottom end flaps 12 and 32 and side end flaps 22 and 42 close the first end 51 of the carton, and the top and bottom end flaps 14 and 34 and side end flaps 24 and 44 close the second end 53 of the carton. In accordance with an alternative embodiment of the present disclosure, different flap arrangements can be used for at least partially closing the ends 51, 53 of the carton 5.

In one embodiment, the top and bottom end flaps 12 and 32 and side end flaps 22 and 42 extend along a first marginal area of the blank 3, and are foldably connected at a first longitudinal fold line 62 that extends along the length of the blank. In the illustrated embodiment, the top and bottom end flaps 14 and 34 and side end flaps 24 and 44 extend along a second marginal area of the blank 3, and are foldably connected at a second longitudinal fold line 64 that also extends along the length of the blank. The longitudinal fold lines 62, 64 may be, for example, substantially straight, or offset at one or more locations to account for blank thickness or for other factors.

In the illustrated embodiment, the bottom panel 30 includes three article protection flaps 72 foldably connected to the bottom panel and arranged in a single row generally located across the longitudinal centerline C1 of the bottom panel. The article protection flaps 72 could be omitted or could be otherwise shaped, arranged, positioned, and/or configured without departing form the disclosure. In the embodiment of FIG. 1, the end flaps 22, 24, 32, 34, 42, 44 include article protection features 74 in the form of deformations in the end flaps that cooperate to provide cushioning for the containers in the carton 5. The article protection features 74 could be omitted or could be otherwise shaped, arranged, positioned, and/or configured without departing from the disclosure. Further, the carton 5 could have a dispenser comprising a removable dispenser panel or other features without departing from the disclosure. The article protection features and flaps can be similar to, or the same as, those described in U.S. patent application Ser. No. 13/419,740, filed Mar. 14, 2012, the disclosure of which is hereby incorporated by reference for all purposes as if presented herein in its entirety. The article protection features 74 and/or the article protection flaps 72 can be otherwise shaped, arranged, and/or configured without departing from the disclosure. Further, the article protection features 74 and/or article protection flaps 72 can be omitted without departing from the disclosure.

As shown in FIG. 1, the features that form the handles 11 of the carton 5 include an elongate handle flap 131, 132 formed in respective top end flaps 12, 14 and foldably attached to the top end flap at a respective arcuate or longitudinal fold line 133, 134. The handle flap 131 is separable from the top end flap 12 along a cut or tear line 136, and the handle flap 132 is separable from the top end flap 14 along a cut or tear line 137. The features that form the first handle 11 further include cutouts 140, 142 in the respective side end flaps 22, 42. The side end flaps 22, 42 can also include respective upper portions 141, 143 disposed above the respective cutouts 140, 142. In the illustrated embodiment, the second handle 11 is formed from features that are substantially similar to the features that form the first handle 11 including cutouts 144, 146 and upper portions 145, 147 of side end flaps 24, 44. The second handle 11 could have different features than the first handle without departing from the disclosure. Further, the second handle 11 can be omitted without departing from the disclosure. One or both of the handles 11 could be otherwise shaped, arranged, configured, or omitted, without departing from the disclosure.

Figure 2:
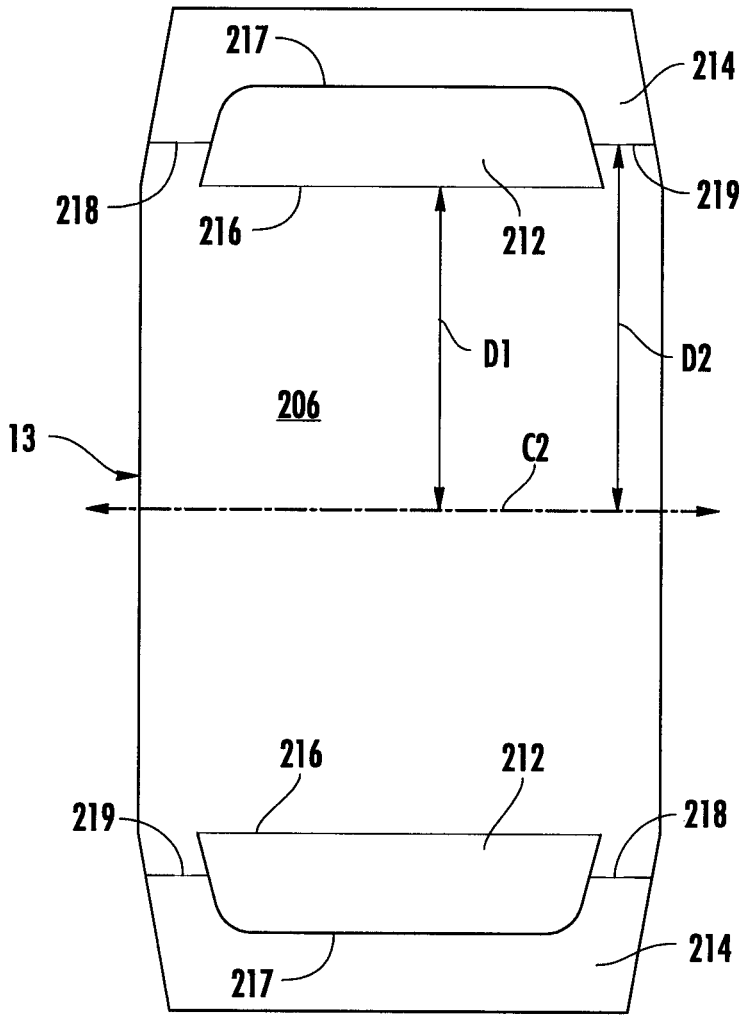
FIG. 2 is a plan view of a reinforcing insert according to the exemplary embodiment of the disclosure.

FIG. 2 illustrates the reinforcing insert 13 for use in the carton 5 (FIGS. 3, 8, and 9) according to the exemplary embodiment of the disclosure. In the illustrated embodiment, the insert 13 includes a central panel 206 and two end flaps 212, 214 at each end of the central panel. The end flaps 212 (broadly "first end flaps") are foldably connected to the central panel 206 at fold lines 216 and are defined by cuts 217 extending from ends of the fold lines. In one embodiment, the cuts can be generally U-shaped cuts extending from each end of the respective fold line 216. Each of the end flaps 214 (broadly "second end flaps") is foldably connected to the central panel 206 along fold lines 218, 219 that extend from the respective cut 217 to a respective edge of the insert 13. The fold lines 216 are each spaced from the centerline C2 of the insert 13 by a distance D1 that is less than the distance D2 from the fold lines 218, 219 to the centerline C2. The end flaps 212 are the article retention end flaps of the insert 13 and the end flaps 214 are the handle reinforcement end flaps of the insert. The article retention end flaps 212 and the handle reinforcement end flaps 214 could be otherwise, shaped, arranged, and/or configured without departing from the disclosure.

Figure 3:
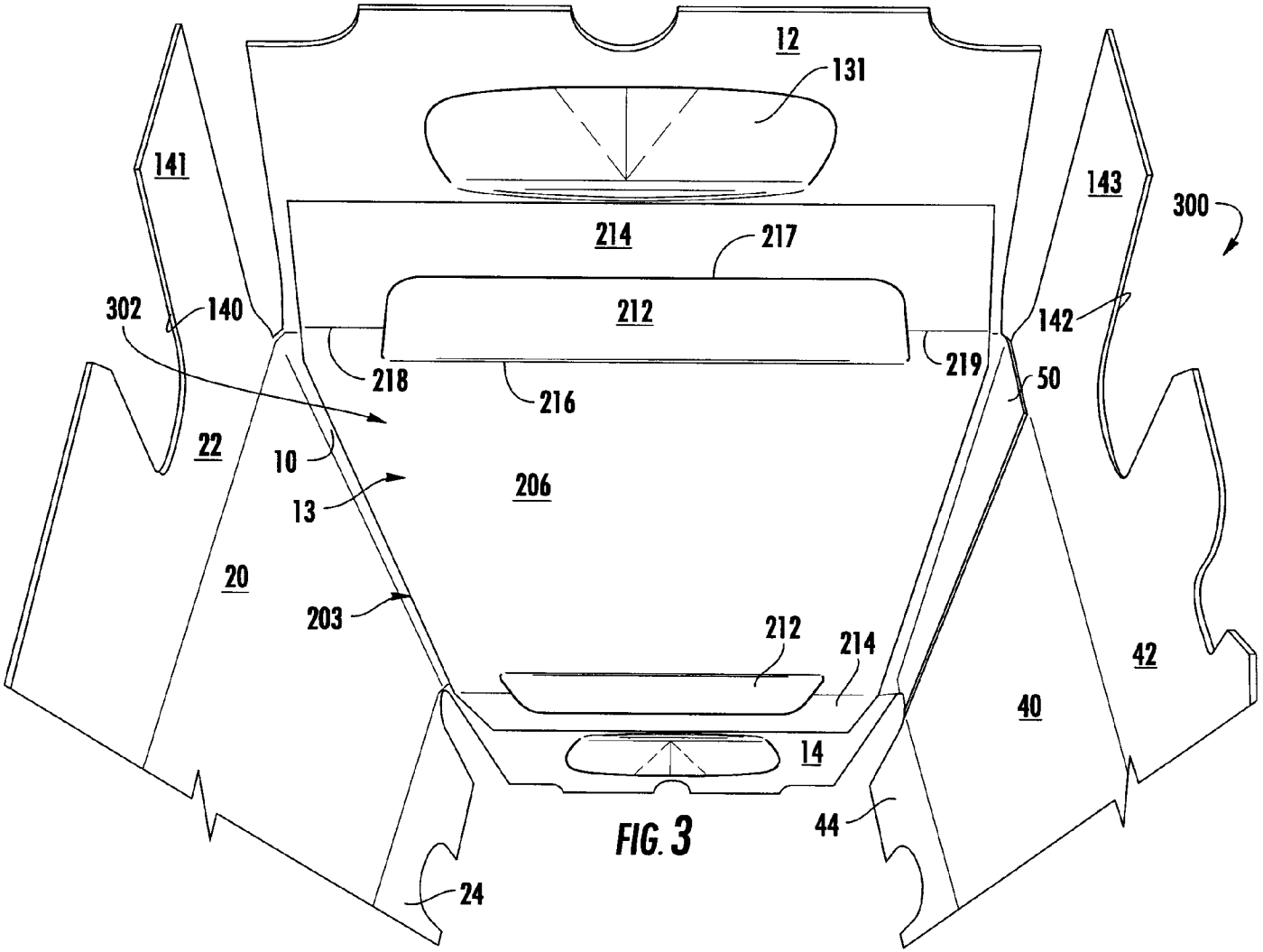
FIG. 3 is a perspective view of an open-ended sleeve formed from the carton blank of FIG. 1 with the reinforcing insert of FIG. 2 according to the exemplary embodiment of the disclosure.
Figure 5:
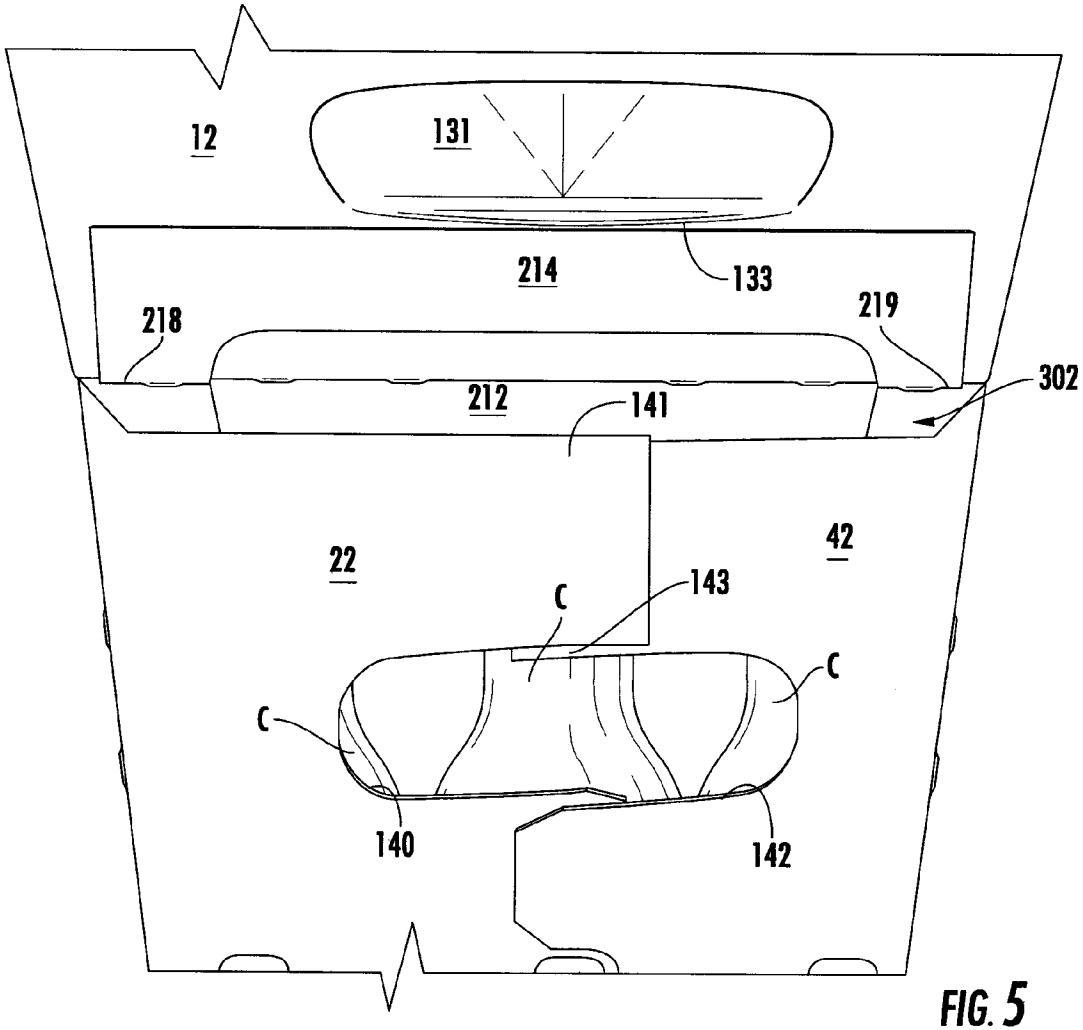
FIG. 5 is a perspective view of the partially closed end of the open-ended sleeve. according to the exemplary embodiment of the disclosure

As shown in FIGS. 3-5, in one exemplary embodiment, the carton 5 can be assembled by initially adhering the insert 13 to the top panel 10 of the carton blank 3. The insert 13 is positioned on the carton blank 3 so that the central panel 206 is in generally face-to-face contact with the top panel 10. The insert 13 is sized so that the fold lines 218, 219 connecting the handle reinforcement end flaps 214 to the central panel 206 are generally aligned with and overlay fold lines 62, 64 connecting the top end flaps 12, 14 to respective ends of the top panel 10. In one embodiment, the centerline C2 of the reinforcing insert 13 can be generally aligned with and overlay the centerline C1 in the top panel 10. The central panel 206 of the insert 13 can be at least partially adhesively secured to the top panel 10 of the carton blank 3. In one embodiment, the handle reinforcement end flaps 214 can be adhesively attached to the top end flaps 12, 14 and are sized to fit adjacent the respective handle flaps 131, 132. As shown in FIGS. 3-5, the handle reinforcement flap 214 can be in face-to-face contact with at least a portion of the first top end flap 12 extending from the handle fold line 133 to the longitudinal fold line 62 connecting the first top end flap 12 to the top panel 10. Similarly, the other reinforcement flap 214 can be in face-to-face contact with at least a portion of the second top end flap 14 extending from the handle fold line 134 to the longitudinal fold line 64 connecting the second top end flap 14 to the top panel 10. In one embodiment, the article retention end flaps 212 are free from adhesive connection to the top panel 10 and the end flaps 12, 14.

In accordance with the exemplary embodiment, the carton blank 3 with insert 13 can be further erected into the carton 5 by folding along fold lines 21, 31, 41, and 52 and adhering the attachment flap 50 to the second side panel 40 to form an open-ended sleeve 300 with an interior 302 (FIG. 3). Containers C can be loaded into the interior 302 of the open-ended sleeve 300 (FIG. 4). In one embodiment, the containers C could be loaded before or after closing either or both of the ends 51, 53 of the carton. The carton blank 3 may be otherwise configured to have multiple top panels, multiple bottom panels, multiple side panels, or combinations thereof without departing from the scope of this disclosure.

Figure 6:
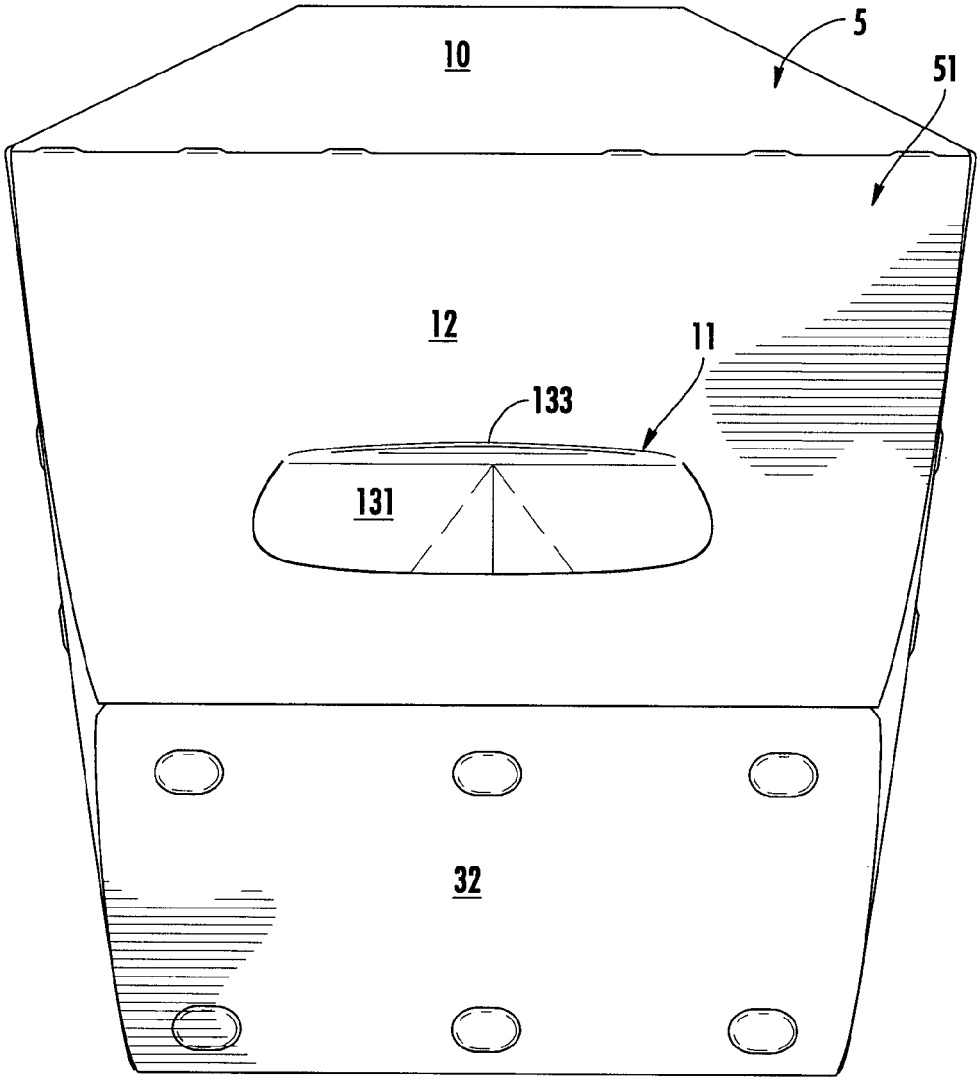
FIGS. 6 and 7 are perspective views of an end of the erected carton according to the exemplary embodiment of the disclosure.

In one embodiment, the first end 51 of the carton 5 can be closed as shown in FIGS. 4-6. As shown in FIG. 4, the first end flap 212 of the insert 13 can be downwardly folded over the end. The first end flap 212 can be separated from the second end flap 214 along the cut 217 to form an edge 220 as the first end flap is downwardly folded. In the illustrated embodiment, the first end flap 212 extends obliquely from the central panel 206 and the top panel 10, and an interior surface of the first end flap can contact the tops CP of the containers C adjacent the end 51 (FIG. 9). As shown in FIG. 5, the side end flaps 22, 42 are inwardly folded to at least partially close the first end 51. In the exemplary embodiment, the side end flaps 22, 42 partially overlap one another, and the edge 220 of the first end flap 212 can be adjacent and/or in contact with the interior surface of one or both of the upper portions 141, 143 of the respective side end flaps 22, 42 (FIGS. 8 and 9).

The top end flap 12 with handle reinforcing flap 214 attached thereto can be downwardly folded to further at least partially close the first end 51, and the bottom end flap 32 can be upwardly folded to further close the first end 51. As shown in FIGS. 5, 8, and 9, the article retention end flaps 212 are on the inside of the carton 5 such that the lower edge 220 of the article retention end flaps contacts the interior surface of the side end flaps 22, 42. The article retention end flaps 212 are folded downward from the central panel 206 such that the article retention end flaps are generally oblique relative to the top panel 10 of the carton 5. The article retention flaps 212 contact the tops CP of the containers C located adjacent the end 51 of the carton 5 so that movement of the containers C is restrained in the carton. In one embodiment, the article protection flaps 72 in the bottom panel 30 also restrain movement of the containers C. The article retention end flaps 212 could be otherwise shaped, arranged, positioned, and/or located without departing form the disclosure. In the illustrated embodiment, the second end 53 can be closed (not shown) in a similar or identical manner as the first end 51. The first end 51 and/or the second end 53 could be closed by other steps without departing from the disclosure.

Figure 7:
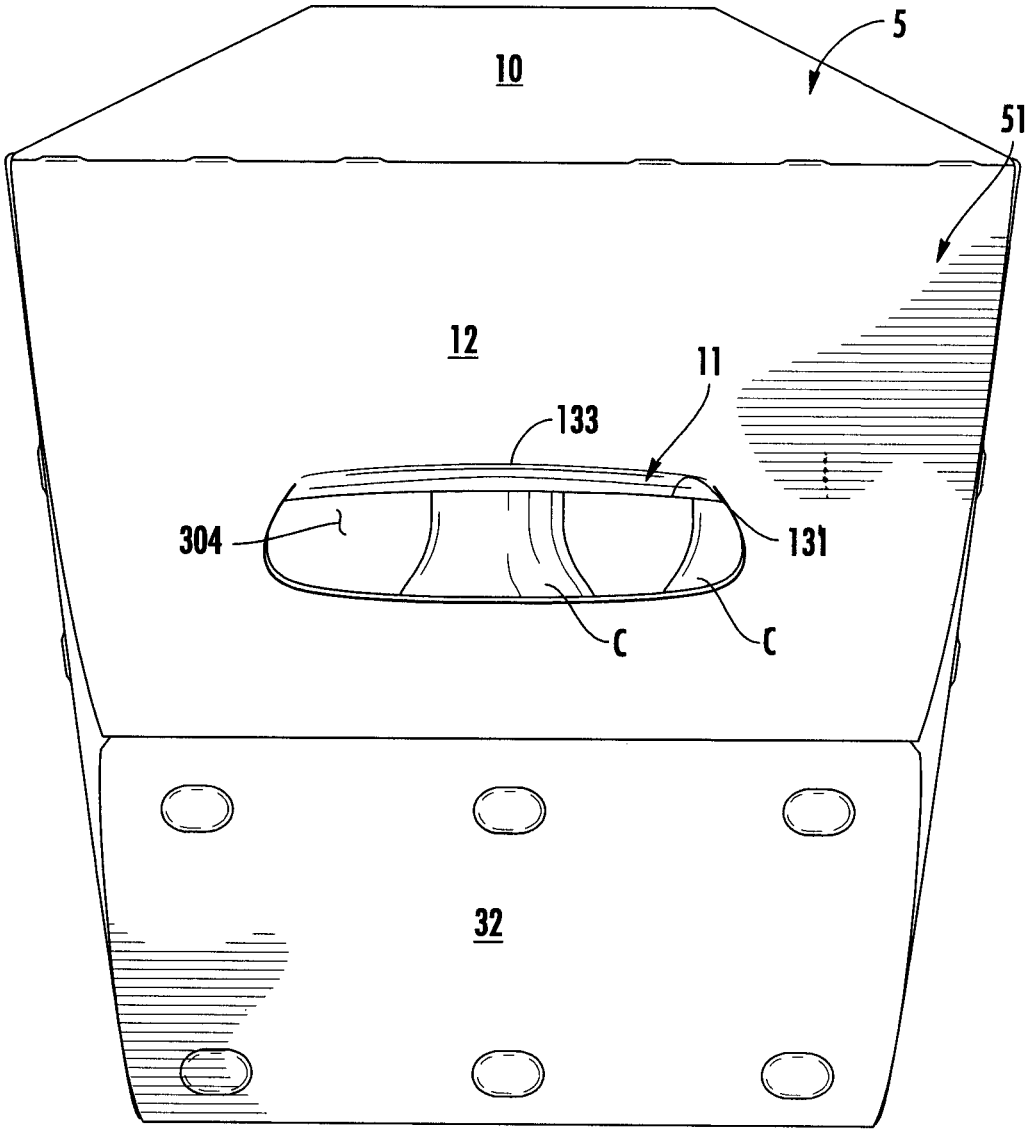

The erected carton 5 according to the exemplary embodiment is shown in FIG. 5. In the illustrated embodiment, as the upper portions 141, 143 are placed in overlapping relationship and the cutouts 140, 142 are generally aligned to form an opening to provide clearance for inwardly folding the handle flap 131 when the side end flaps 22, 42 are closed (FIGS. 5 and 8). Then the top end flap 12 and handle reinforcement end flap 214 are downwardly folded from the position of FIG. 5 so the handle reinforcement flap extends across and is in face-to-face contact with the overlapped upper portions 141, 143 to reinforce and strengthen the handle 11. Four plies of material are provided directly above the handle 11 (the overlapped upper portions 141, 143, the handle reinforcement flap 214, and the top end flap 12) prior to activation of the handle flaps 131, 132. When the handle flaps 131, 132 are inwardly folded and pushed upwardly in the direction of arrow A1 (FIG. 8), the upwardly folded handle flap 131, 132 provides a fifth layer of material that reinforces the handle 11. When the handle 11 is activated and the handle flap 131 is folded inwardly as shown in FIGS. 7 and 8, the handle forms a handle opening 304 in the top end flap 12 aligned with the cutouts 140, 142 in the side end flaps 22, 42. The handle 11 may be otherwise shaped, arranged, configured, or could have other reinforcing features without departing from the disclosure. Further, one or more of the handles could be omitted without departing from the disclosure.

As shown in FIG. 9 with a portion of the side panel 40 cut away, the article retention end flaps 212 are positioned to be generally oblique relative to the top panel 10 and contact the tops CP of the containers C in the row of containers adjacent a respective end 51, 53 of the carton 5. The article retention end flaps 212 can help to stabilize the containers C in the carton 5 and are located adjacent the corners of the carton at the ends 51, 53 to provide the article protection features of a two-sided taper carton in a battery-box style carton having orthogonal corners.

The carton 5 could have dispenser features or other features without departing from the disclosure. Also, the carton 5 can have different or additional handle features, or the handle features could be omitted, without departing from the disclosure. Further, the carton 5 could have additional or different article protection features without departing from the disclosure.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding a plurality of containers, the carton comprising:

a plurality of panels that extends at least partially around an interior of the carton, the plurality of panels comprising a top panel, a bottom panel, a first side panel, and a second side panel;

a plurality of end flaps respectively foldably connected to respective panels of the plurality of panels, the plurality of end flaps is at least partially overlapped with respect to one another to thereby at least partially form a closed end of the carton;

a handle formed in the closed end of the carton;

a reinforcing insert comprising a central panel, a first insert end flap foldably connected to the central panel along a first fold line, and second insert end flap foldably connected to the central panel along a second fold line, the top panel at least partially overlapping the central panel, the first insert end flap being positioned for contact with at least one of the plurality of containers, and the second insert end flap being positioned for reinforcing the handle, wherein the first fold line is spaced apart from the closed end, the first insert end flap extends from the first fold line to the closed end, and the second insert end flap is at least partially in overlapping relationship with the plurality of end flaps in the closed end.

2. The carton of claim 1, wherein the first fold line is spaced apart from the second fold line.

3. The carton of claim 2, wherein the first fold line is spaced apart from a centerline of the reinforcing insert by a first distance and the second fold line is spaced apart from the centerline of the reinforcing insert by a second distance, the second distance being greater than the first distance.

4. The carton of claim 3, wherein the plurality of end flaps are foldably connected to the respective panels along a third fold line, the third fold line generally overlaps the second fold line, the top panel overlaps the first fold line, and the first insert flap extends from the top panel toward the closed end at an oblique angle.

5. The carton of claim 2, wherein the first insert end flap is at least partially defined by a cut extending from at least one end of the first fold line, and the second fold line extends from the cut to an edge of the reinforcing insert.

6. The carton of claim 2, wherein the first insert end flap is at least partially defined by a generally U-shaped cut extending from a first end and a second end of the first fold line, and at least a portion of the second insert end flap extends adjacent the generally U-shaped cut.

7. The carton of claim 1, wherein the plurality of end flaps comprises a top end flap foldably connected to the top panel along a third fold line, the handle comprises a handle flap foldably connected to the top end flap along a fourth fold line, and at least a portion of the top end flap extending from the third fold line to the fourth fold line overlaps the second insert end flap.

8. The carton of claim 7, wherein the plurality of end flaps further comprise at least one side end flap foldably connected to at least one of the first side panel and the second side panel, the at least one side end flap comprises a cutout and an upper portion extending adjacent the cutout, the cutout is generally aligned with the handle flap, and the second insert end flap overlaps the upper portion of the at least one side end flap.

9. The carton of claim 8, wherein the second insert end flap is at least partially in face-to-face contact with at least a portion of an interior surface of the top end flap and with at least a portion of an exterior surface of the upper portion of the at least one side end flap.

10. The carton of claim 8, wherein the at least one side end flap comprises a first side end flap foldably connected to the first side panel and a second side end flap foldably connected to the second side panel, the upper portions of the respective first side end flap and second side end flap being at least partially overlapped so that the closed end of the carton comprises at least four plies of material disposed above the handle.

11. The carton of claim 8, wherein the first insert end flap extends in an oblique direction from the top panel and comprises an edge at least partially in contact with an interior surface of the at least one side end flap.

12. In combination a carton blank and a reinforcing insert for forming a carton for holding a plurality of containers:

the carton blank comprising:

a plurality of panels comprising a top panel, a bottom panel, a first side panel, and a second side panel;

a plurality of end flaps respectively foldably connected to respective panels of the plurality of panels, the plurality of end flaps for being at least partially overlapped with respect to one another to thereby at least partially form a closed end of the carton formed from the carton blank and the reinforcing insert;

handle features for forming a handle in the closed end of the carton formed from the carton blank and the reinforcing insert; and the reinforcing insert comprising a central panel, a first insert end flap foldably connected to the central panel along a first fold line, and second insert end flap foldably connected to the central panel along a second fold line, the top panel at least partially overlapping the central panel, the first fold line being spaced apart from the plurality of end flaps and the second insert end flap, the first insert end flap being positioned for contact with at least one of the plurality of containers so that the first insert end flap extends from the first fold line to the closed end when the carton is formed from the carton blank and the reinforcing insert, and the second insert end flap being at least partially overlapped by an end flap of the plurality of end flaps, wherein the second insert end flap is for being positioned for reinforcing the handle when the carton is formed from the carton blank and the reinforcing insert, and the second insert end flap is for being at least partially in overlapping relationship with the plurality of end flaps in the closed end when the carton is formed from the carton blank and the reinforcing insert.

13. The combination of claim 12, wherein the first fold line is spaced apart from the second fold line.

14. The combination of claim 13, wherein the first fold line is spaced apart from a centerline of the reinforcing insert by a first distance and the second fold line is spaced apart from the centerline of the reinforcing insert by a second distance, the second distance being greater than the first distance.

15. The combination of claim 14, wherein the plurality of end flaps are foldably connected to the respective panels along a third fold line, the third fold line generally overlaps the second fold line, and the top panel overlaps the first fold line.

16. The combination of claim 13, wherein the first insert end flap is at least partially defined by a cut extending from at least one end of the first fold line, and the second fold line extends from the cut to an edge of the reinforcing insert.

17. The combination of claim 13, wherein the first insert end flap is at least partially defined by a generally U-shaped cut extending from a first end and a second end of the first fold line, and at least a portion of the second insert end flap extends adjacent the generally U-shaped cut.

18. The combination of claim 12, wherein the plurality of end flaps comprises a top end flap foldably connected to the top panel along a third fold line, the handle comprises a handle flap foldably connected to the top end flap along a fourth fold line, and at least a portion of the top end flap extending from the third fold line to the fourth fold line overlaps the second insert end flap.

19. The combination of claim 18, wherein the plurality of end flaps further comprise at least one side end flap foldably connected to at least one of the first side panel and the second side panel, the at least one side end flap comprises a cutout and an upper portion extending adjacent the cutout, the cutout is for being generally aligned with the handle flap when the carton is formed from the carton blank and the reinforcing insert, and the second insert end flap is for being positioned to overlap the upper portion of the at least one side end flap when the carton is formed from the carton blank and the reinforcing insert.

20. A method for forming a carton for holding a plurality of containers, the method comprising:

obtaining a carton blank and a reinforcing insert, the carton blank comprising a plurality of panels comprising a top panel, a bottom panel, a first side panel, and a second side panel, a plurality of end flaps respectively foldably connected to respective panels of the plurality of panels, and handle features, and the reinforcing insert comprising a central panel, a first insert end flap foldably connected to the central panel along a first fold line, and second insert end flap foldably connected to the central panel along a second fold line;

positioning the reinforcing insert relative to the carton blank so that the top panel at least partially overlaps the central panel and an end flap of the plurality of end flaps at least partially overlaps the second insert end flap;

forming an interior of the carton at least partially defined by the plurality of panels, the forming the interior of the carton comprising forming an open-ended sleeve;

at least partially closing an end of the carton by at least partially overlapping the plurality of end flaps with respect to one another and positioning the second insert end flap to be at least partially in overlapping relationship with the plurality of end flaps in the closed end, the at least partially closing the end of the carton comprising forming a handle in the end of the carton from the handle features and positioning the second insert end flap to reinforce the handle; and positioning the first insert end flap for contact with at least one of the plurality of containers and so that the first insert end flap extends from the first fold line to the closed end, wherein the first fold line is spaced apart from the closed end.

21. The method of claim 20, wherein the first fold line is spaced apart from a centerline of the reinforcing insert by a first distance and the second fold line is spaced apart from the centerline of the reinforcing insert by a second distance, the second distance is greater than the first distance, and the positioning the first insert end flap comprises folding the first insert end flap downwardly along the first fold line.

22. The method of claim 21, wherein the plurality of end flaps are foldably connected to the respective panels along a third fold line, the third fold line generally overlaps the second fold line, the top panel overlaps the first fold line, and the folding the first insert end flap downwardly along the first fold line comprises positioning the first insert flap to extend from the top panel toward the closed end at an oblique angle.

23. The method of claim 20, wherein the plurality of end flaps comprises a top end flap foldably connected to the top panel along a third fold line, the handle features comprise a handle flap foldably connected to the top end flap along a fourth fold line, and the positioning the reinforcing insert relative to the carton blank comprises positioning the second insert end flap so that at least a portion of the top end flap extending from the third fold line to the fourth fold line overlaps the second insert end flap.

24. The method of claim 23, wherein the plurality of end flaps further comprise at least one side end flap foldably connected to at least one of the first side panel and the second side panel, the at least one side end flap comprises a cutout and an upper portion extending adjacent the cutout, the forming the handle comprises generally aligning the cutout with the handle flap, and the positioning the second insert end flap to reinforce the handle comprises positioning the second insert end flap to overlap the upper portion of the at least one side end flap.

25. The method of claim 24, wherein the at least one side end flap comprises a first side end flap foldably connected to the first side panel and a second side end flap foldably connected to the second side panel, the at least partially overlapping the plurality of end flaps comprises at least partially overlapping the upper portions of the respective first side end flap and second side end flap so that the closed end of the carton comprises at least four plies of material disposed above the handle after the at least partially closing the end of the carton.

26. The method of claim 24, wherein the first insert end flap comprises an edge, and the positioning the first insert end flap for contact with at least one of the plurality of containers comprises positioning the first insert end flap to extend in an oblique direction from the top panel and positioning the edge of the first insert end flap to be at least partially in contact with an interior surface of the at least one side end flap.

* * * * *